US006117061A

United States Patent [19]

Popat et al.

[11] Patent Number: 6,117,061

[45] Date of Patent: Sep. 12, 2000

[54] METHOD FOR CUSTOM PRINTING AND FORMING THREE-DIMENSIONAL STRUCTURES

[75] Inventors: Ghanshyam H. Popat, Alta Loma; Gustav Ray, Huntington Beach; Russell D. Pollman, Pomona, all of Calif.

[73] Assignee: Avery Dennison Corporation, Pasadena, Calif.

[21] Appl. No.: 08/897,856

[22] Filed: Jul. 21, 1997

[51] Int. Cl.[7] ..... B31B 1/88

[52] U.S. Cl. ..... 493/325; 493/356

[58] Field of Search ..... 493/325, 356, 493/944, 959; 40/124.14, 124.15, 107, 539; 283/2, 4, 34

[56] References Cited

U.S. PATENT DOCUMENTS

| | | | |
|---|---|---|---|
| 989,406 | 4/1911 | Pearson . | |
| 1,246,385 | 11/1917 | Bimeler . | |
| 1,692,886 | 11/1928 | Brown . | |
| 1,799,490 | 4/1931 | Westerman . | |
| 1,827,964 | 10/1931 | Amsden . | |
| 2,525,937 | 10/1950 | Palm . | |
| 2,546,878 | 3/1951 | Townley . | |
| 2,572,460 | 10/1951 | Falk . | |
| 3,517,449 | 6/1970 | Frandsen et al. . | |
| 3,571,958 | 3/1971 | Stevens | 40/124.1 |
| 3,730,818 | 5/1973 | Salinari . | |
| 3,788,934 | 1/1974 | Coppa . | |
| 3,894,352 | 7/1975 | Hooker . | |
| 4,280,241 | 7/1981 | Pfaff . | |
| 4,285,683 | 8/1981 | Cross | 493/325 |
| 4,319,418 | 3/1982 | Transport . | |
| 4,349,346 | 9/1982 | Bromberg | 493/325 |
| 4,502,711 | 3/1985 | Muth . | |
| 4,517,251 | 5/1985 | Mosely . | |
| 4,657,612 | 4/1987 | Schoenleber . | |
| 4,685,680 | 8/1987 | Rubik . | |
| 4,708,911 | 11/1987 | Mage . | |
| 4,726,802 | 2/1988 | Volk, Jr. | 493/325 |
| 4,729,182 | 3/1988 | Sherman | 40/124 |
| 4,788,109 | 11/1988 | Mage . | |
| 4,794,024 | 12/1988 | Crowell et al. . | |
| 4,898,404 | 2/1990 | Babcock . | |
| 4,917,405 | 4/1990 | Muth et al. . | |
| 5,018,764 | 5/1991 | Beardell . | |
| 5,057,067 | 10/1991 | Hibsch | 493/325 |
| 5,083,389 | 1/1992 | Alperin . | |
| 5,112,290 | 5/1992 | Hibsch | 493/325 |
| 5,132,915 | 7/1992 | Goodman | 364/479 |
| 5,181,901 | 1/1993 | Volkert . | |

(List continued on next page.)

OTHER PUBLICATIONS

Print Paks Catalog, Apr. 1996.
Print Paks Personalized Pinwheels Quick Start, Feb. 1996.
Print Paks Special Paper for Making Pinwheels Date Believed to be Feb. 1996.

*Primary Examiner*—Linda Johnson
*Attorney, Agent, or Firm*—Oppenheimer Wolff & Donnelly LLP

[57] ABSTRACT

Generally speaking, a method for forming custom-printed, three dimensional structures using a computer and a computer-controlled printer, has several steps. A flexible rectangular sheet is perforated to form a removable portion. Lines of weakness are formed on the removable portion, to serve as fold lines that ultimately folding the two-dimensional removable portion into a three-dimensional structure. A user instructs a computer program to command a computer-controlled printer to print particular information onto the printing surface of said removable portion. After printing, the user removes the removable portion from the sheet along the perforations and then folds the removable portion along the lines of weakness and secures the folded sheet into a three dimensional structure. The removable portion may be provided with a pressure-sensitive, water-activated, cohesive or other type of adhesive for adhering securing the folded sheet into the three-dimensional structure. The computer program enables the user to design the custom-printing for the structure, and optionally to preview the ultimate appearance of the three-dimensional structure.

28 Claims, 3 Drawing Sheets

U.S. PATENT DOCUMENTS 5,238,269 8/1993 Levine ..... 281/2
5,364,017 11/1994 Bennett .
5,383,684 1/1995 Smath .
5,454,644 10/1995 Augustin .
5,472,364 12/1995 Castleman .
5,538,288 7/1996 Heath ..... 283/2
5,792,297 8/1998 Hunter et al. ..... 156/211
5,853,837 12/1998 Popat ..... 428/43

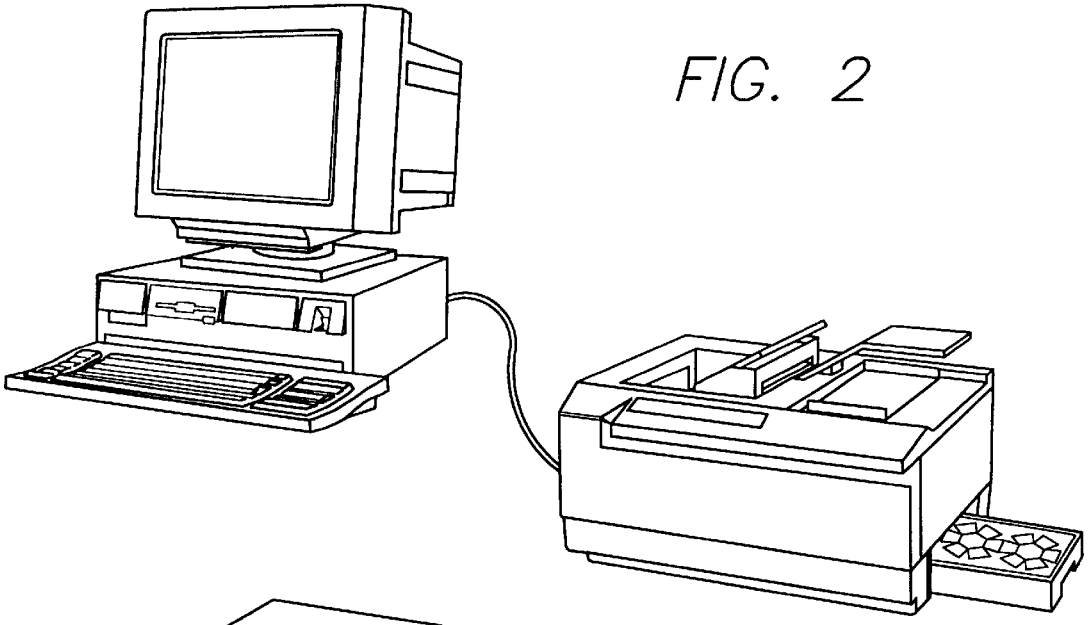
FIG. 2
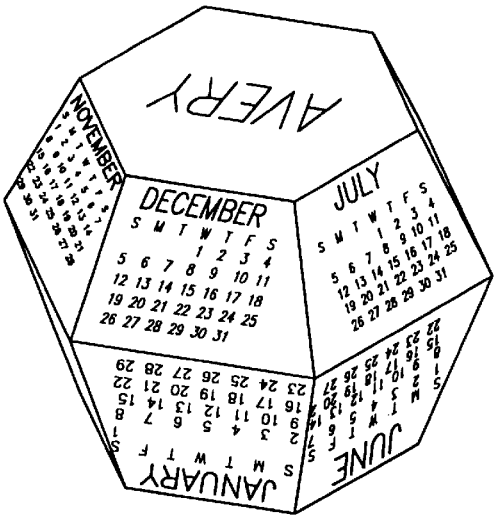
FIG. 3
FIG. 5
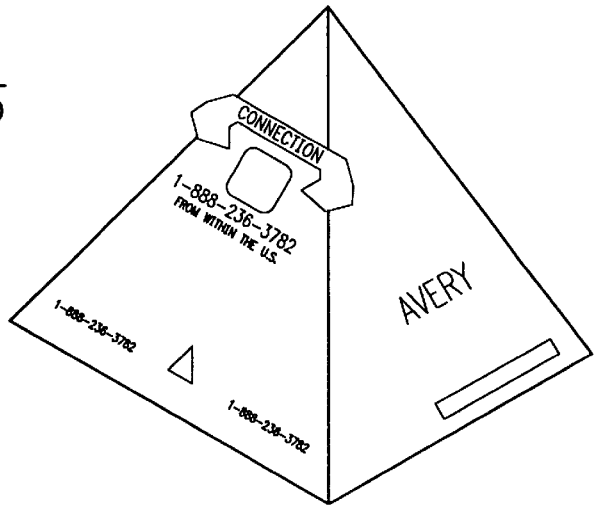

METHOD FOR CUSTOM PRINTING AND FORMING THREE-DIMENSIONAL STRUCTURES

BACKGROUND OF THE INVENTION

1. Field of the Invention

The present invention relates to sheets for printing in office printers, such as laser, inkjet and thermal transfer printers, and specifically to a printable sheet having lines of weakness which define the boundaries of a removable portion and other lines of weakness defining fold lines within the removable portion; wherein the sheet is custom printed and the removable portion thereof is ultimately formed into a three-dimensional structure that displays the custom printing.

2. Background of the Invention

One way large businesses advertise themselves is with pre-printed three dimensional structures made of cardstock. The structures typically have information printed on them, such as the name, address and phone number of the business. Such structures can also be used to convey information, such as highlighting dinner specials on a restaurant table. U.S. Pat. Nos. 4,794,024, 4,319,418 and 3,730,818 generally provide examples of this type of structure.

When used to convey information, such structures are typically printed at a commercial printer and are quite expensive, as there is normally a setup charge for preparing the press to print the desired design, as well as charges to have the three dimensional structures assembled. The process is generally cost-prohibitive to small businesses that desire a small number of custom-printed structures.

One attempt has been made to create custom-printed pinwheels utilizing a standard sheet of paper and a desktop printer. The user enters information into a computer program, which then causes a design to be printed on the sheet of paper. After printing, the user cuts the design from the sheet of paper, and forms the paper into a pinwheel. This approach is awkward, however. The user must cut the design with scissors, which frequently results in imperfectly cut designs. To get a single, perfectly-cut design, some users would likely be required to print the design over and over again until the user happened to cut the design without error.

Furthermore, once the user has successfully cut the design from the sheet with scissors, the user must then adhere the sheet together with glue or tape, which is time consuming. Additionally, glue has a tendency to be messy, and extra glue on the printed surface will make the printed surface appear to be messy. Adhesive tape, while less messy than glue, detracts from the overall appearance of the printed surface.

SUMMARY OF THE INVENTION

Generally speaking, a more efficient and less error-prone method for forming custom-printed, three dimensional structures using a computer and a computer-controlled printer, has several steps. A flexible rectangular sheet is perforated to form a removable portion. Lines of weakness are formed on the removable portion, to serve as fold lines that facilitate subsequent folding of the two-dimensional removable portion into a three-dimensional structure. A user instructs a computer program to command a computer-controlled printer to print particular information onto the printing surface of said removable portion. After printing, the user removes the removable portion from the sheet along the perforations and then folds the removable portion along the lines of weakness and secures the folded sheet into a three dimensional structure.

The user may secure the structure together in various ways. For example, the forming step may include providing pressure-sensitive adhesive on at least one area of the sheet, with release-coated backing material covering the adhesive. The adhesive may alternatively be water-activated, or even activated in the printing step by printing onto the adhesive with a liquid ink. A further alternative is to use a cohesive adhesive, in which one area of adhesive bonds with another area of adhesive when the two come into contact with one another.

To assist in securing the structure together, the removable portion may include tab portions which are adhered together in the securing step. The tab portions may be color-coded to guide a user in securing said three-dimensional structure together. Alternatively, the removable portion may be provided with slits, into which the tabs are inserted during the securing step.

The removable portion may be entirely blank prior to the printing step, or may include preprinting portions in certain areas while leaving other portions blank for user-defined custom printing in the printing step. The sheet may also be pre-printed with instructions to the user in areas outside of the removable portion.

The present invention may be provided in a kit, which includes several pre-perforated sheets and a computer program with which the user designs the custom-printed exterior portion of the finished three-dimensional structure. The computer program may include a plurality of templates, each corresponding to a particular sheet size and/or perforation pattern. The step of instructing a computer program would then include selecting a template corresponding to the particular sheet size and/or perforation pattern to be used. The user would then input or select text and/or graphics for specific areas of the template, and the computer program would display the text and/or graphics on a computer monitor, as they would appear after printing onto the corresponding pre-perforated sheet. The computer program may also optionally display the three-dimensional structure as it would appear after the securing step. Various options may be available to the user, such as the ability to view the structure from various vantage points, to adjust the position of text and graphics on the three-dimensional structure, and/or to change the colors of the custom printing.

A standard set of images and/or text can be provided to the user on a CD ROM or other storage medium, which may be included in the kit. The user can then select images and/or standard text, such as passages from literature and famous quotes, for printing onto the structure. The user can also import text and graphics from external files, including scanned photographs. An optional database interface can be provided with the computer program so that the user can customize each structure with specific information, such as a particular customer's name.

The three-dimensional structure can be formed from more than one pre-perforated sheet. The method can include perforating one or more additional rectangular sheets and custom-printing as with the initial sheet. The removable portions of the various sheets are then combined to form a single three-dimensional structure. Alternatively, individual custom-printed structures can be formed from the sheets and then arranged to form mobiles, custom printed building blocks, custom printed puzzles and so on.

Other objects, features and advantages of the invention will become apparent from a consideration of the following detailed description and from the accompanying drawings.

BRIEF DESCRIPTION OF THE DRAWINGS

FIG. 2 is a perspective view of a desktop printer, with a supply of sheets as shown in FIG. 1 loaded therein, prior to printing;

FIG. 3 a perspective view of a custom-printed, three-dimensional structure constructed by removing the removable area of FIG. 1 along the lines of perforation, then folding the removed area along lines of weakness and securing the structure into its three-dimensional configuration;

FIG. 5 is a custom-printed, three-dimensional pyramid constructed from the removable area of the perforated sheet of FIG. 4.

DETAILED DESCRIPTION

Figure 1:
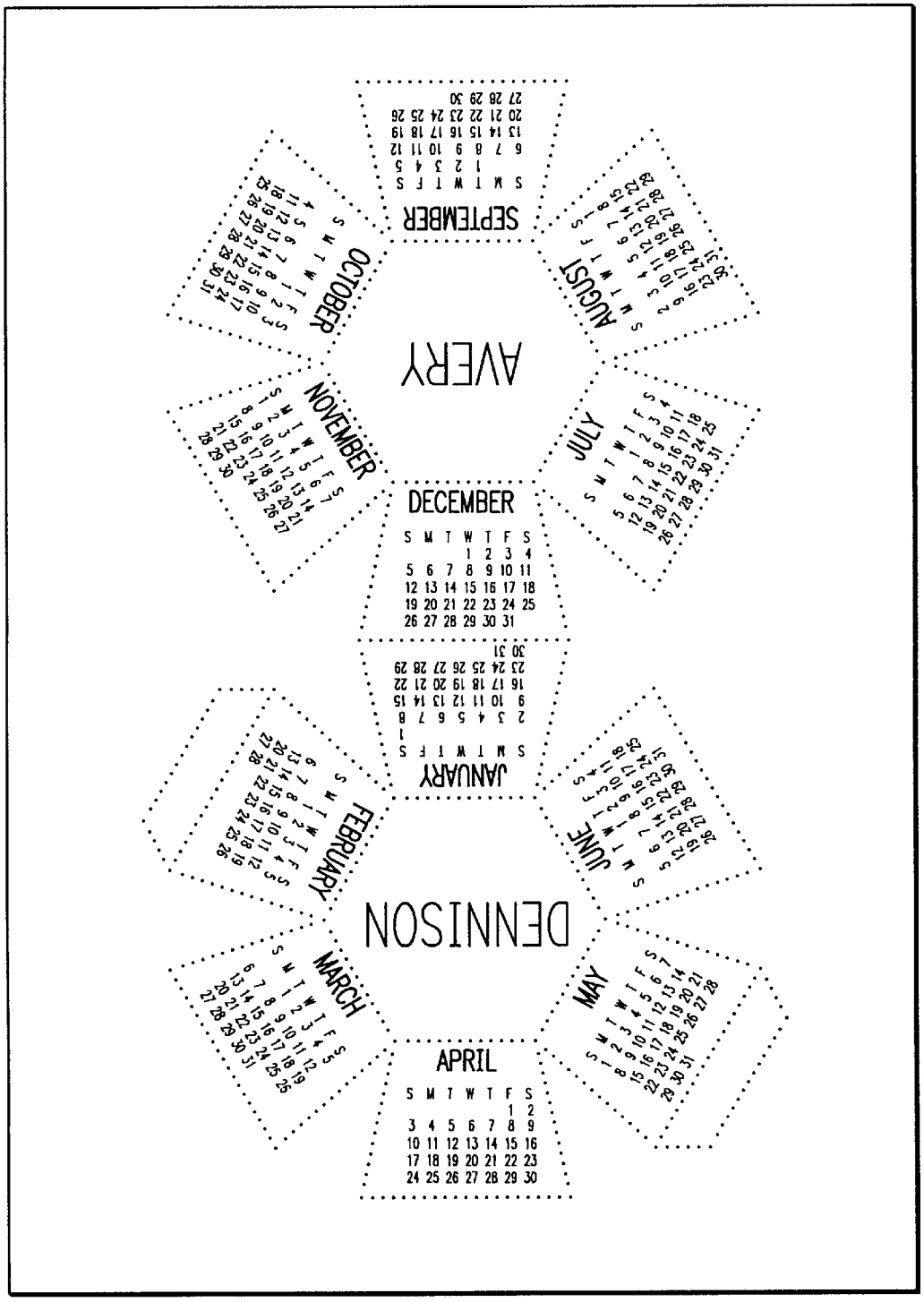
FIG. 1 is a front view of a flat sheet having a pattern perforated thereon, lines of weakness, and printing that a desktop printer has printed.

FIG. 1 illustrates one embodiment of a sheet structure according to the present invention. The sheet 20 is preferably formed of light card stock and is initially blank, although pre-printed instructions for use can be provided in areas of the sheet that do not ultimately form the exterior of the three dimensional structure. The sheet includes patterns of microperforations 22 that define a removable area 24 of the sheet. The microperforations are closely spaced perforations that leave a relatively smooth edge when the removable portion is separated from the sheet 20 after printing. Generally, microperforations have approximately 35 cuts and ties per inch.

The sheet also includes lines of weakness 26, which are also known as fold lines, at various locations. The lines of weakness are typically score lines, but can alternatively be formed with rough perforations or other known methods. The lines of weakness 26 serve two purposes. First, after the removable area has been printed and removed along the microperforations from the sheet, the lines of weakness indicate where the user should fold the removable area in order to form the three dimensional structure. Secondly, the lines of weakness allow the user to fold the removable area in exactly the right location and orientation, thereby giving the final product a professional appearance.

To create a custom-printed, three-dimensional structure from the initially blank sheet, the user first prints on the removable area 24 with a standard office printer, such as an inkjet, laser or thermal transfer printer. Most commonly, the printer will be a color desktop printer, such as a color inkjet printer, although the printer can be a larger, high speed office printer if a high volume of sheets is to be printed. FIG. 2 illustrates a printer 36 into which a user has loaded a supply of sheets 20 prior to the printing step.

The printing may consist of text and/or graphics. The user may select the text and/or graphics from a standard library that is provided on CD-ROM or in computer software to be used in conjunction with the sheets 20, or may print custom text and/or graphics. In FIG. 1, a computer program has generated and printed standard calendar text on each of the leaves 28 of the removable area 24. In addition, the user has defined the words "Avery" and "Dennison" for the central portions 30 *a,b* of the removable portion 24.

With a color printer, the user can customize the colors of the text and the graphics. For example, the corporate name "Avery Dennison" can be printed in the company colors, or any other colors that the user defines. Similarly, a color printer can print color graphics onto the removable area, such as a color photograph of company headquarters or of the founder of the corporation.

Once the removable area has been printed with text and/or graphics, the next step in constructing the three dimensional structure is to remove the removable portion 24 from the sheet 20. To do so, the user applies pressure to the lines of microperforation 22 until the removable portion 24 is free of the sheet 20. Because the perforations are closely spaced, the edges of the removable portion 24 are fairly smooth. Furthermore, the lines of microperforation 22 precisely define the edges of the three-dimensional structure. The edges are therefore perfectly formed, and do not suffer the problems of imprecision that arise from cutting edges with scissors.

With the removable portion 24 now removed from the sheet 20, the user folds the removable portion 24 along the lines of weakness 26 into a three-dimensional structure. FIG. 3 shows the removable portion 24 as it appears once it has been folded into a multi-sided calendar 32. To hold the structure together, the preferred embodiment is provided with tabs 34, which FIG. 1 illustrates. The tabs are provided with adhesive, are folded at lines of weakness and are adhered to corresponding portions of the structure, to hold the structure in place There are various types of adhesives that may be employed on the tabs 34. In the preferred embodiment, the tabs 34 are coated with a pressure sensitive adhesive and are covered with a thin piece of release-coated backing material. The adhesive may cover the tab entirely, or may be applied in patterns or over only a portion of the tab. In FIG. 1, the tabs on the lower portion of the Figure all include patches of pressure-sensitive adhesive 35 covered with corresponding silicone-coated pieces of backing material. When the user is ready to adhere the tab in place to hold the structure together, the user simply removes the release-coated backing material to expose the pressure sensitive adhesive.

Preferably, the pressure sensitive adhesive that is employed is repositionable when initially adhered, and becomes permanently adhered over time. For instance, the adhesive may be repositionable for approximately the first five to ten minutes after a tab has been adhered in place, so that the user can reposition the tab if it is misaligned. However, thereafer the adhesive becomes less and less repositionable with time such that the tab is eventually permanently set in place. Alternatively, an adhesive that is permanently repositionable may be employed.

As an alternative to a pressure-sensitive adhesive, the tabs 34 may be coated with a water activated adhesive. The user must then moisten the adhesive, either by licking the tab or by blotting the tab with a wet cloth. As a further alternative, the tab may be coated with a special water-activated adhesive onto which the inkjet printer would print, thereby activating the adhesive. Most inkjet printing ink is water based, and therefore would activate the adhesive on contact. Adhesives that are particularly well-suited for activation with ink jet printer ink are described in detail in currently pending Patent Cooperation Treaty Application No. 96/13908, which was filed on Aug. 26, 1996 and which is hereby incorporated by reference. It should be noted, however, that a potential drawback of activating the adhesive with the ink jet printer ink is that the user normally must adhere the tab to the appropriate portion of the structure before the ink jet printer ink on the adhesive dries. However, the user may actually want to wait until the ink dries before removing the removable section 24 from the sheet, as ink jet printer ink sometime smears before it is dry. Consequently, other types of adhesives, such as pressure sensitive adhesives, are presently considered preferable to inkjet ink-activated adhesives.

As a further alternative to pressure-sensitive adhesives, cohesive adhesives may be employed. These are adhesives that are normally not tacky, but which become tacky when put into contact with a mating substance. Cohesive adhesives are known in the art. One cohesive adhesive is available from Moore Business Forms.

In addition to the various adhesives discussed above, single or double-sided transparent adhesive tape may be employed in alternative embodiments, although this is not the preferred way to secure the structure in place. Additionally, rather than adhering the tabs in place, the removable portion 24 may include die-cut slits (not shown) into which the tabs may be inserted to hold the structure in place. As a further alternative, the structure may be held in place with rubber bands, in the manner described in U.S. Pat. No. 4,794,024, which is hereby incorporated by reference.

The presently preferred embodiments of the invention have non-rectangular removable areas, because non-rectangular areas form the basis for the most interesting three dimensional structures. For instance, the calendar 32 of FIG. 3 is a six-sided structure, with top and bottom for printing company or other information. The two-dimensional form 24 (FIG. 1) that forms the basis of the structure 32 is a multi-leafed structure that is not itself rectangular.

Figure 4:
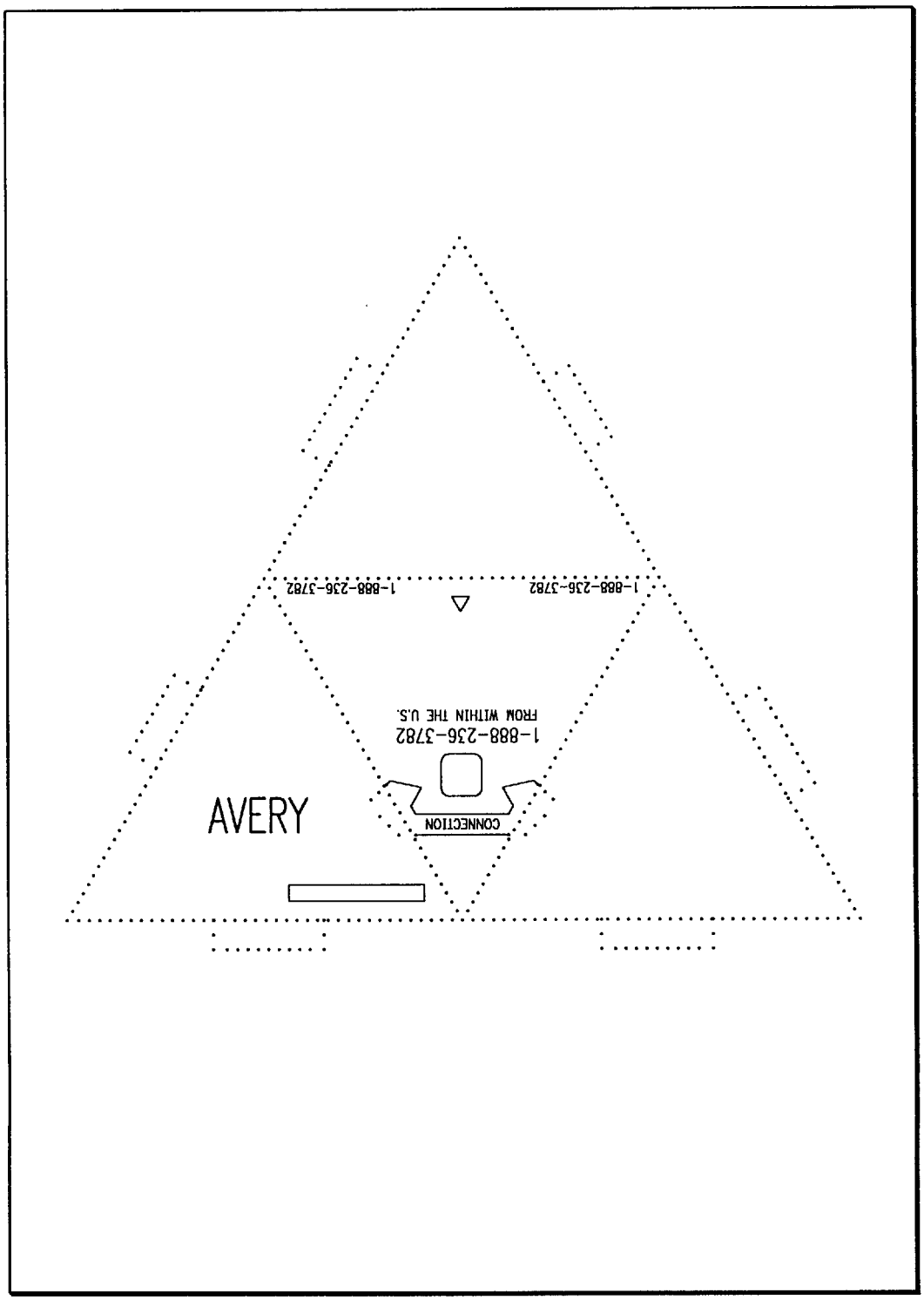
FIG. 4 is an alternative embodiment of a flat perforated sheet for forming a customprinted three-dimensional pyramid.

Similarly, the removable portion 124 of FIG. 4 is a substantially triangular area that punches out to form the custom-printed, three-dimensional pyramid 132 of FIG. 5. The removable portion 124 includes lines of weakness 126 which constitute fold lines. Tabs 134 are provided and may be coated with an adhesive to ultimately secure the structure together after custom printing. Indicia 146 is custom printed with a desktop printer, and standard indicia 148 may be pre-printed onto the removable portion 124 in advance. Pre-printed indicia is useful when certain standard information is common to several different users, and a particular user then need only custom-print the name of the user or the user's company 146.

Considering this alternative embodiment further, the pyramid has a special "pop-out" section 140. With reference to FIG. 5, the ends of this "pop-out" section extend beyond the edges of the pyramid when the removable portion 124 of sheet 120 (FIG. 4) has been folded into the pyramid 132. Referring to FIG. 4, the edges of the "pop-out" portion 140 are defined by microperforations or die-cuts 142. After the user removes the removable portion 124 from the sheet 120, he or she separates the edges 142 of the "pop-out" portion 140 from the removable portion 124. Then, when the user constructs the pyramid 132 from the removable portion 124, the edges 142 of the "pop-out" section extend beyond the edges of the pyramid. This sort of "pop-out" section is eye-catching, and draws attention to a slogan or short message 144 printed thereon.

The presently preferred embodiment of the invention includes software that enables the user to compose the custom-printed text and graphics on a computer before printing onto the sheet. A presently preferred embodiment of the software has a menu from which the user selects the form of the sheet to be printed. For example, to compose the text and graphics to print the blank for a pyramid of FIG. 4, the user would select the menu item corresponding to the sheet size and perforation pattern of FIG. 4.

Once the user has selected the particular sheet size and perforation pattern, the software displays a graphical representation, or "template", of the selected sheet on the computer monitor, indicating perforation lines and lines of weakness. The user then indicates by means of a computer mouse or other input device a location on the template in which to put text or graphics.

The custom-printed text and graphics can either be entirely input by the user, either directly or by importing pre-existing files, or chosen from a library provided with the software, from which user chooses a standard image, such as a butterfly, or a background pattern, such as polka dots, or standard text, such as a poem or quotes from famous historical or literary people. For example, to generate the custom printing in FIG. 1, the user can choose a calendar pattern from the computer software and indicate the year for which the calendar is to be. The software then generates the calendar and displays it on the computer monitor in the proper areas of the removable portion of the selected sheet. The user may then add custom printing or advertising to selected blank areas on the removable portion of the sheet.

In one embodiment of the software, the user may enter a command to generate a three-dimensional representation of how the structure will appear once constructed, including the custom text and/or graphics that are to be printed on the exterior of the structure. The user is then able to determine, in advance of actually printing the structure, if she wants to make revisions to the design. She can also experiment with various color schemes, text fonts, and graphic design elements, with instant results on the computer monitor. The software may optionally have commands to rotate the structure, to view the structure from various viewpoints, to display the structure on a desktop or other environment, and/or perform various other graphic functions that are useful to the designer, such as permitting the user to reposition text and graphics on the three-dimensional structure, as desired.

Once the user has custom-designed the three-dimensional structure to her satisfaction, she can then instruct the software to print the design onto a pre-microperforated sheet, such as those illustrated in FIGS. 1 and 4. The software then sends the necessary set of print instructions to the computer-controlled printer, such as a laser, inkjet or thermal transfer printer, to print the custom design on the pre-microperforated sheet. The software can be resident on a single desktop computer, or may be accessed remotely as, for example, through a computer network or over the internet.

The presently preferred embodiments of the assembly are made of light cardstock, but can be made of paper, mylar, or various other materials, including fabric. The sheet can be a blend of materials or can be a composite of different materials, such as metalized mylar and light cardstock or another printable surface, with the metalized mylar for dramatic appearance and cardstock in areas where printing is to be seen. A transparent, three-dimensional structure can be constructed from an assembly of transparent mylar that has a print-receptive coating on at least the portion of the sheet that is to be printed. Mylar sheets that are coated with a print-receptive coating for printing are known in the art.

The foregoing detailed description describes presently preferred embodiments of the invention, as well as a few alternative features. However, various modifications and changes may be employed without departing from the spirit and scope of the invention. For example, multiple pre-microperforated sheets may be printed to ultimately form a large and/or somewhat complex three-dimensional structure. The removable portion or portions of each sheet would define a portion of the ultimate structure. For instance, to take a somewhat creative example, the present invention can be packaged as a kit for designing and creating three-dimensional animals with custom-printed text for advertising a pet store. The kit includes multiple, pre-microperforated sheets with lines of weakness serving as fold lines in the proper locations. Each sheet defines one or more particular component of an animal, such as the torso, the legs, the head, and so on.

The kit also includes software as described above, for custom designing the advertising text that is to be printed on the animal, such as the name and address of the pet shop, as well as the coloring and fur pattern of the animal. The software can also color code the tabs (see reference numeral 34 of FIG. 1 for an example of a tab) to assist the user in adhering a tab or tabs from one component to the proper location or tab of another component, in order to properly interlink the components to form the three-dimensional animal structure.

As another creative example, the user can form a large custom-printed structure by arranging individual custom printed, three-dimensional structures together. For example, a large Mayan-style pyramid can be formed from individual cube-shaped boxes in a step configuration. A large Egyptian-style pyramid can be made with an assortment of cube-shaped boxes and boxes having a single wall that is slanted at an angle. The boxes can be adhered together to permanently form the pyramid, or can be loosely arranged so that the user can later from a different structure with the same custom printed boxes.

A creative advertising technique involves creating a custom-printed puzzle for an end user to assemble. This embodiment of the invention includes a software feature that divides the custom-printed graphics and text among several pre-microperforated sheets that a user forms into individual structures, such as cubical or pyramid-shaped boxes. After the user has printed the sheets and formed the custom-printed box structures, the end recipient of the puzzle must then arrange the individual boxes in such a manner as to unscramble the overall advertising text, graphics, logos and so on.

Other examples of applications for the present invention include custom printing and assembling three-dimensional shapes to be hung on a string to form a mobile for a baby's room. Using the software described above, the parents could print one letter on each pre-microperforated sheet, so that the structures together spell the baby's name on the mobile. The parents could choose the color scheme of the custom-printed structures to match the color scheme of baby's room. Consequently, it should be noted that while the primary embodiments of the present invention are directed to commercial business advertising applications, the invention is not so limited.

Further examples of applications for the present method include preparing custom printed holiday ornaments, cars, trains, planes, party favors, three-dimensional corporate organization charts, flow charts, business card holders, photo display units printed with digitized photographs, models of fruits and vegetables, match boxes, boxes for shipping items, bridges for model train sets, lunch boxes, compact disc boxes, coin holders, among others. The custom-printed items can be printed individually, or in batches for multiple print outs of a single custom design.

With regard to the computer software described herein, software performing a wide variety of functions has been described. However, even relatively simple software packages can facilitate the design to be custom printed. For example, the Visio software, produced by the Visio Corporation, has been used to create simple templates and to input and print customized designs.

Accordingly, the claims are not limited to the illustrative examples of the invention described herein.

What is claimed is:

1. A method for forming custom-printed, three dimensional structures using a computer and a computer-controlled printer, comprising the steps of:

providing a perforated flexible rectangular sheet having a removable portion, and having lines of weakness on said removable portion, said removable portion having a printing surface;

instructing a computer program to custom print particular information onto said printing surface of said removable portion;

custom printing said information on said printing surface of said removable portion of said rectangular sheet with a computer-controlled desktop printer;

after printing, removing said removable portion from the sheet along the perforations;

after removing said removable portion from said sheet, folding said removable portion along said lines of weakness into a three dimensional structure having an exterior; and securing said sheet material into its three dimensional configuration with said information appearing on the exterior of the three dimensional structure, said securing step being facilitated by applying an adhesive to at least one area of said removable portion of said sheet prior to the printing step and conveniently securing the three dimensional structure together with the adhesive after the printing step.

2. A method as defined in claim 1, wherein said adhesive is provided on said sheet in the form of at least one area of pressure-sensitive adhesive that is covered with at least one piece of release-coated backing material.

3. A method as defined in claim 1, wherein said adhesive is provided on said sheet in the form of at least one area of water-activated adhesive.

4. A method as defined in claim 1, wherein said adhesive is provided on said sheet in the form of complementary areas of cohesive adhesive.

5. A method as defined in claim 1, wherein said adhesive is provided on said sheet in the form of an adhesive that is activated by inkjet printer ink, the printing step including printing onto said adhesive with an inkjet printer to activate said adhesive.

6. A method as defined in claim 1, wherein said removable area further comprises tab portions and wherein the step of securing said three-dimensional structure comprises adhering tab portions together.

7. A method as defined in claim 6, wherein said tab portions are color coded to guide a user in securing said three-dimensional structure together.

8. A method as defined in claim 1, further comprising the step of preprinting portions of said removable portion while leaving at least one other portion of said removable portion blank for printing in said printing step.

9. A method as defined in claim 1 wherein said computer program includes a plurality of templates, each corresponding to a particular sheet perforation pattern that defines a removable portion, and wherein the step of instructing a computer program further comprises selecting a template corresponding to the particular sheet perforation pattern to be used.

10. A method as defined in claim 1 wherein the method further comprises, prior to the printing step, displaying a computer-generated graphical representation of the three dimensional structure as it would ultimately appear with said information printed on its exterior.

11. A method as defined in claim 1, wherein said flexible rectangular sheet has a second removable portion defined by perforations, the method further comprising the steps of:

in the step of printing, further custom printing information on said second removable portion of said rectangular sheet material with the computer-controlled desktop printer;

after printing, removing said second removable portion from the sheet along the perforations;

connecting said second removable portion to said three dimensional structure.

12. A method as defined in claim 1, wherein a second perforated flexible rectangular sheet is provided having a removable portion and lines of weakness on the removable portion, the removable portion including a printing surface, further comprising the steps of:

instructing a computer program to custom print particular information onto said printing surface of said removable portion of said second sheet;

custom printing said information on said printing surface of said removable portion of said second sheet with a computer-controlled printer;

after printing, removing said removable portion from said second sheet along the perforations;

after removing said removable portion from said second sheet, folding said removable portion along said lines of weakness into a second three dimensional structure having an exterior;

securing said sheet material into its three dimensional configuration with said printing surface exposed on said exterior; and arranging said first and second three dimensional structures together to form a combined three-dimensional structure.

13. A method as defined in claim 12 wherein the step of arranging said first and second three dimensional structures together to form a combined three dimensional structure comprises adhering said first and second three dimensional structures together.

14. A method for forming custom-printed non-rectangular three dimensional printed structures using a computer and a computer controlled printer comprising the steps of:

1) providing a microperforated rectangular sheet material such as paper or light weight card stock, with the micronerforations defining an inner non-rectangular area, said sheet material including lines of weakness elsewhere on said sheet material;

2) printing on the rectangular sheet material with an office printer;

3) removing some of the material along the microperforated lines;

4) folding said sheet material along said lines of weakness to form a non-rectangular, three dimensional structure having an exterior; and 5) securing said sheet material that has been removed from said rectangular sheet into its three dimensional configuration with printing exposed on said exterior.

15. A method for forming non-rectangular three dimensional printed structures as defined in claim 14, wherein said step of printing on the rectangular sheet material comprises printing onto said inner non-rectangular area.

16. A method for forming non-rectangular three dimensional printed structures as defined in claim 15, wherein said securing step further comprises securing the three dimensional structure together with an adhesive that is applied to said sheet prior to the custom printing step.

17. A method for forming non-rectangular three-dimensional printed structures as defined in claim 16, wherein said adhesive is provided on said sheet in the form of at least one area of pressure-sensitive adhesive that is covered with at least one piece of release-coated backing material.

18. A method for forming non-rectangular three-dimensional printed structures as defined in claim 16, wherein said adhesive is provided on said sheet in the form of at least one area of water-activated adhesive.

19. A method for forming non-rectangular three-dimensional printed structures as defined in claim 15, wherein said non-rectangular area further comprises tab portions.

20. A method for forming non-rectangular three-dimensional printed structures as defined in claim 19, wherein the step of securing said three-dimensional structure comprises adhering tab portions together.

21. A method for forming non-rectangular three-dimensional printed structures as defined in claim 19, wherein said three dimensional structure further comprises slits, and the step of securing said three-dimensional structure comprises inserting said tabs into corresponding ones of said slits.

22. A method for forming non-rectangular three-dimensional printed structures as defined in claim 19, wherein said tab portions are color coded to guide a user in securing said three-dimensional structure together.

23. A method for forming non-rectangular three dimensional printed structures as defined in claim 15, wherein said securing step further comprises securing the three dimensional structure together with rubber.

24. A method for forming non-rectangular three-dimensional printed structures as defined in claim 15, wherein said inner area is initially blank, and wherein said printing step further comprises printing multi-colored graphics, and text, onto said inner area with a computer-controlled, color printer.

25. A method for forming non-rectangular three-dimensional printed structures as defined in claim 15, further comprising the step of preprinting portions of said sheet material prior to said custom printing step, while leaving at least one other portion of said sheet material blank for printing in said custom printing step.

26. A method for forming custom-printed, three dimensional structures using a computer and a desktop printer, such as a laser printer, ink jet printer or thermal transfer printer, comprising the steps of:

providing a microperforated supply of flexible sheets, with microperforations forming a removable portion on each sheet, each of said sheets including lines of weakness on said removable portion, said removable portion having a printing surface;

designing a first exterior design to be printed on a first sheet from said supply;

printing said first design on the printing surface of said removable portion of said first sheet with the printer;

after printing said first design, removing the removable portion from said first sheet along the perforations;

after removing said removable portion from said first sheet, folding said removable portion along said lines of weakness into a first three dimensional structure having an exterior;

securing said removable portion of said first sheet into a three dimensional configuration with said first design exposed on said exterior;

designing a second exterior design that is different from said first exterior design to be printed on a second sheet from said supply;

printing said second design on the printing surface of said removable portion of said second sheet with the printer;

after printing said second design, removing the removable portion from said second sheet along the perforations;

after removing said removable portion from said second sheet, folding said removable portion along said lines of weakness into a second three dimensional structure having an exterior;

securing said removable portion of said second sheet into a three dimensional configuration with said second design exposed on said exterior.

27. A method as defined in claim 26, wherein the steps of securing the first and second removable portions into three dimensional structures comprise providing adhesive on said first and second sheets prior to the printing steps, and securing the respective three dimensional structures with the adhesive.

28. A method for forming custom-printed three dimensional printed structures using a computer and a computer controlled printer comprising the steps of:

1) providing perforated sheet material in which perforations define an inner area, and forming lines of weakness elsewhere on said sheet material;

2) printing on the sheet material with an office printer;

3) removing said inner area along the perforated lines;

4) folding said inner area along said lines of weakness to form a three dimensional structure having an exterior; and 5) securing said inner area into its three dimensional configuration with printing exposed on said exterior.

* * * * *